US008201978B2

(12) United States Patent
Ladstätter et al.

(10) Patent No.: US 8,201,978 B2
(45) Date of Patent: Jun. 19, 2012

(54) LAMP WITH A BOX-LIKE LAMP HOUSING ELEMENT AND A LIGHT OUTLET ELEMENT

(75) Inventors: Gerald Ladstätter, Klaus (AT); Patrik Gassner, St. Gerold (AT); Manfred Petschulat, Wolfurt (AT)

(73) Assignee: Zumtobel Lighting GmbH (AT)

( * ) Notice: Subject to any disclaimer, the term of this patent is extended or adjusted under 35 U.S.C. 154(b) by 645 days.

(21) Appl. No.: 12/162,877

(22) PCT Filed: Jan. 31, 2007

(86) PCT No.: PCT/EP2007/000822

§ 371 (c)(1),
(2), (4) Date: May 28, 2009

(87) PCT Pub. No.: WO2007/088036

PCT Pub. Date: Aug. 9, 2007

(65) Prior Publication Data

US 2009/0303737 A1 Dec. 10, 2009

(30) Foreign Application Priority Data

Feb. 1, 2006 (DE) ..... 10 2006 004 579
Apr. 13, 2006 (DE) ..... 10 2006 017 539
Jun. 12, 2006 (DE) ..... 10 2006 027 207

(51) Int. Cl.
*F21V 17/00* (2006.01)

(52) U.S. Cl. ..... 362/364; 362/217.09; 362/307

(58) Field of Classification Search ..... 362/145–148, 362/217.01–217.09, 217.1, 217.11, 222–227, 362/235, 240, 241, 244–248, 260, 268, 277, 362/296.01, 307–309, 326–328, 330, 336–340, 362/347, 351, 355, 364
See application file for complete search history.

(56) References Cited

U.S. PATENT DOCUMENTS

| | | | | | |
|---|---|---|---|---|---|
| 2,242,872 | A | * | 5/1941 | Rolph | 362/330 |
| 2,434,049 | A | | 7/1943 | Nordquist | |
| 2,398,507 | A | * | 4/1946 | Rolph | 362/148 |
| 4,263,639 | A | | 4/1981 | Schacht | |
| 4,295,152 | A | * | 10/1981 | Khoe et al. | 257/680 |
| 4,625,267 | A | * | 11/1986 | Mikalonis | 362/150 |
| 4,729,075 | A | * | 3/1988 | Brass | 362/223 |
| 4,768,140 | A | * | 8/1988 | Szpur | 362/342 |
| 4,891,737 | A | * | 1/1990 | Szymanek | 362/223 |
| 4,910,650 | A | * | 3/1990 | Goralnik | 362/147 |
| 4,933,820 | A | * | 6/1990 | Engel | 362/221 |
| 5,184,881 | A | * | 2/1993 | Karpen | 362/1 |

(Continued)

FOREIGN PATENT DOCUMENTS

DE 10018499 10/2001

(Continued)

*Primary Examiner* — Hargobind S Sawhney
(74) *Attorney, Agent, or Firm* — Cantor Colburn LLP

(57) ABSTRACT

A luminaire having a box-like luminaire housing for receiving at least one elongate light source and at least one reflector surface arranged—seen from the region to be illuminated—neighboring the light source, the luminaire housing forms a light exit opening which is closed by a light exit element. The light exit element has in a first emission region, located in substance in front of the light source, a first light emission characteristic, and has in a second emission region, separate from the first emission region, a second light emission characteristic different with respect to the first light emission characteristic.

21 Claims, 4 Drawing Sheets

U.S. PATENT DOCUMENTS

| | | | | |
|---|---|---|---|---|
| 5,806,968 | A * | 9/1998 | Tsai | 362/225 |
| 6,332,696 | B2 * | 12/2001 | Schepens | 362/311.03 |
| 6,746,133 | B2 * | 6/2004 | Loga et al. | 362/147 |
| 6,913,372 | B2 * | 7/2005 | Allcock et al. | 362/223 |
| 7,261,435 | B2 * | 8/2007 | Gould et al. | 362/223 |
| 7,674,005 | B2 * | 3/2010 | Chung et al. | 362/223 |

FOREIGN PATENT DOCUMENTS

| | | |
|---|---|---|
| EP | 1195551 | 4/2002 |
| EP | 1279889 | 1/2003 |
| GB | 951159 | 1/1963 |
| WO | 0159364 | 8/2001 |

* cited by examiner

LAMP WITH A BOX-LIKE LAMP HOUSING ELEMENT AND A LIGHT OUTLET ELEMENT

TECHNICAL FIELD OF THE INVENTION

The present invention concerns a luminaire which has a box-like luminaire housing for receiving at least one elongate light source and at least one reflector surface arranged—seen from the region to be illuminated—neighbouring the light source, wherein the luminaire housing forms a light exit opening which is closed by a light exit element for the issue of light.

BRIEF SUMMARY OF RELATED ART

A comparable luminaire is known from WO 01/59364 A1 of the applicant. There is involved here a luminaire which on the one hand issues light directionally—that is, within a determined angular range—and with which, on the other hand, the region of the luminaire provided for the directional issue of light is additionally brightened in its surroundings. For this purpose the known luminaire has additional reflector wings which extend to the side from the light source, in front of which light source—seen in emission direction—there is arranged a raster, and diffusers arranged in front of the reflector wings. The reflector wings form, with the diffuser arranged in each case therebefore, so-called light chambers located to the side neighbouring the light source or the raster, into which light chambers a part of the light issued by the light source is incident and is then issued via the diffusers. The configuration of the different elements is thereby so selected that a brightening of the region surrounding the luminaire raster is attained which is as uniform as possible. At the same time the luminaire distinguishes itself by its extremely slight structural height.

The homogeneous issue of light via the diffusers located to the two sides of the rasters in the case of this known luminaire is attained in particular also through a particular configuration of the reflectors and the diffusers. In the case of the known luminaire both elements are formed concavely to attain an improved light distribution. If in this case the known luminaire is used as a recessed ceiling luminaire, this means that the diffuser runs, starting from the edge of the housing, inwardly towards the housing base. In turn this has the consequence that in particular the region around the luminaire raster provided for directional issue of light is susceptible to soiling. Further, although the region surrounding the luminaire raster is brightened, the ceiling region surrounding the luminaire is not brightened. Despite everything, however, this known luminaire is very successful due to its excellent lighting technical qualities.

BRIEF SUMMARY OF THE INVENTION

The invention further develops the luminaire concept known from WO 01/59364 A1 so that additional improvements arise in the points mentioned above. A luminaire which is comparable to the known luminaire with regard to its lighting technical qualities is still, however, to be provided.

A first inventive idea is based on the idea of improving the maintenance factor by particular measures in the configuration of the luminaire. This so-called maintenance factor is dependent upon how often a luminaire must be serviced, whereby here in particular also necessary cleaning of the luminaire is to be understood. In accordance with the invention a high maintenance factor is now attained in that the light exit opening of the luminaire housing is closed by a light exit element which seen over its surface has different light emission characteristics. In a first emission region located in substance in front of the light source the light exit element correspondingly has a first light emission characteristic, whilst in contrast the light exit element has in a second emission region separate from the first emission region a second light emission characteristic different from the first light emission characteristic. Hereby it can in particular be provided that via the first light emission region a directional issue of light is effected, whilst in contrast the light emission characteristic of the second emission region is such that here the light is issued diffusely.

In accordance with this first aspect of the invention there is correspondingly proposed a luminaire having a box-like luminaire housing for receiving at least one elongate light source and at least one reflector surface arranged—seen from the region to be illuminated—neighbouring the light source, wherein the luminaire housing forms a light exit opening which is closed by a light exit element. In accordance with the invention the light exit element has in a first emission region, located in substance in front of the light source, a first light emission characteristic, and has in a second emission region, separate from the first emission region, a second light emission characteristic different with respect to the first light emission characteristic.

Through the use of a light exit element which issues the light in a different way in different regions the maintenance factor of the luminaire can be improved in comparison with the known solution of WO 01/59364 A1, since the region of the luminaire responsible for the issue of light is no longer formed by a plurality of different components which in a configuration arranged beside one another are difficult to clean. Thereby the maintenance factor of the luminaire can then in particular be particularly optimized when, according to an advantageous development of the present invention, the underside of the light exit element is in substance flat and is located in the plane of the light exit opening of the housing. Finally, in this case the recessed lamp ends flush with the surrounded ceiling region, which brings particular advantages when cleaning the luminaire. At the same time, however, as in the case of the known luminaire, a part of the light may be issued directionally and the other part of the light may be issued diffusely, so that the luminaire in accordance with the invention has comparable lighting technical qualities as the state of the art.

The ranges of application of the luminaire in accordance with the invention can further be improved in accordance with a further development of the present invention in that the light exit element is adjustable in light emission direction. In this case there is in particular the possibility of allowing the light exit element to project slightly with respect to the the luminaire housing. Through this the possibility is opened up of issuing light via side wall regions of the light exit element also to the side and additionally brightening the ceiling region surrounding the luminaire. The lighting technical qualities of the luminaire in accordance with the invention are correspondingly further improved. Thereby it can in particular be provided that the light exit element forms a unit with the light source and the reflector surface which is adjustable in common with respect to the luminaire housing. In this way it is ensured that the arrangement of light source(s), reflector surface(s) and light exit element with respect to one other always remains the same.

As already mentioned, the light exit element used in the case of the luminaire in accordance with the invention is preferably configured such that the light leaving the luminaire via the first emission region of the light exit element is emitted solely in a determined angular range, thus is emitted directionally. In this way a dazzle-free illumination of the room lying below the luminaire is attained. The luminaire in accordance with the invention is thus in particular suitable also for use at display workstations at which reflections on the surface of a screen or the like are to be avoided.

These particular optical qualities of the light exit element can for example be attained in that this has in the first emission region a light influencing element influencing the issue of light in a corresponding manner, in particular a prism structure, grid structure or raster structure. For this purpose it can be provided that the light exit element is formed by a light exit plate—constituted preferably in one piece—which in substance is transparent in the first emission region, wherein at the upper and/or underside of the light exit plate a prism element, grid element or raster element is arranged. This light influencing element may be connected to the light exit plate in one piece; there is, however, also the possibility to adhere, latch or to otherwise connect this element to the upper side or underside with the light exit plate. Such prism, grid or raster structures are for example known from DE 103 15 268 A1 or the DE 10 2004 039 676 A1 and will be explained in more detail below. The second emission region, surrounding the first emission region, may for example be treated such that the preferred diffuse issue of light is attained.

The concept already mentioned above, of so forming light exit element that it is adjustable with respect to the luminaire housing in light emission direction, can also be used independently of whether or not the light exit element has different light emission characteristics in different regions. Independently thereof, namely, the advantage is obtained that with a position of the light exit element at which it slightly projects with respect to the luminaire housing, the ceiling region surrounding the recessed lamp is brightened.

In accordance with a second aspect of the present invention there is correspondingly proposed a luminaire having a box-like luminaire housing for receiving at least one elongate light source and at least one reflector surface arranged—seen from the region to be illuminated—neighbouring the light source, wherein the luminaire housing forms a light exit opening which is closed by a light exit element, and wherein the light exit element is adjustable in light emission direction.

The brightening of the ceiling region surrounding the luminaire can finally also be attained by a further measure which is subject of a third aspect in accordance with the invention. This concept is based on the idea of forming the light exit element of a plurality of part elements, wherein a first part element is arranged in substance in front of the light source and a second part element is arranged in substance in front of the reflector surface, and wherein the first and/or the second part element—seen in light emission direction—are adjustable. With this variant there is the possibility now of allowing at least one of the two part elements to project beyond the luminaire housing, whereby then in turn light is so issued via the side walls that the surrounding ceiling region is brightened.

Thus in accordance with this third aspect of the invention there is proposed a luminaire having a box-like luminaire housing for receiving at least one elongate light source and at least one reflector surface arranged—seen from the region to be illuminated—neighbouring the light source, wherein the luminaire housing forms a light exit opening which is closed by a light exit element and wherein in accordance with the invention it is provided that the light exit element is of a plurality of part elements, wherein a first part element is arranged in substance in front of the light source and a second part element is arranged in substance in front of the reflector surface, and wherein the first and/or the second part element is adjustable seen in light emission direction. The first part element has preferably a first light emission characteristic and the second part element has a second light emission characteristic different with respect to the first light emission characteristic, so that in turn the possibility of a directional issue of light and a supplementary diffuse illumination is made possible.

The reflector surface—preferably concave or extending wing-like—may be formed in accordance with a first variant by means of an independent reflector; that is, a component separate from the luminaire housing. It would, however, also be conceivable in a second variant to form at least a part of the reflector surface by the housing inner wall.

Overall, through the present invention, a new luminaire concept is proposed which leads to a luminaire which can be cleaned simply with a high maintenance factor, and particularly advantageous lighting technical qualities.

BRIEF DESCRIPTION OF THE DRAWINGS

Below, the invention will explained in more detail with reference to the accompanying drawings. There is shown.

DETAILED DESCRIPTION OF THE INVENTION

Figure 1:
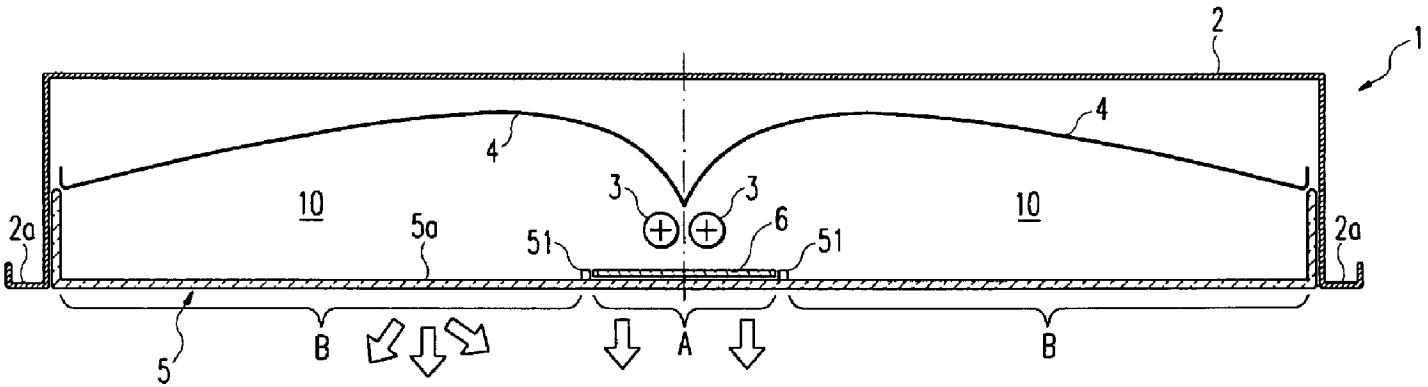
FIG. 1 a sectional illustration of a first embodiment of a luminaire in accordance with the invention.

In the case of recessed ceiling luminaire illustrated in FIG. 1 and provided overall with the reference sign 1 the different components of the luminaire 1 are arranged within a box-like luminaire housing 2, which upon installation of the luminaire 1 is recessed into the ceiling of the room to be illuminated. For this purpose the luminaire housing 2 has edge strips 2*a* projecting at the side, which when placing the housing 2 into a mounting opening of the ceiling come to bear against the ceiling and completely close the mounting opening. These edge strips 2*a* may also further have—not illustrated—mountings which make possible an adaptation to the thickness of the ceiling and correspondingly ensure that the luminaire housing 2 in principle ends flush with the surrounding ceiling.

Within the housing 2 there are firstly arranged two rod-shaped gas discharge lamps, in particular fluorescent lamps 3, which serve as light sources of the luminaire 1 and extend centrally through the luminaire housing 2. Of course, the number and kind of light sources could also be varied. The light of these gas discharge lamps 3 is issued via the light exit opening formed at the forward or underside of the housing 2, wherein the issue of light is effected via a light exit element which is to be described in more detail below, which is provided with the reference sign 5. To ensure that the light issued by the gas discharge lamps 3 is used completely and effectively for illumination, there are further provided two reflectors 4, formed wing-like, which extend to the two sides of the light sources 3 towards the edge region of the housing 2. Thereby the reflectors 4 are constituted in particular concavely, preferably curved concavely, since through this particular form a very uniform issue of light is made possible. As an alternative to the illustrated embodiment also a single reflector, spanning completely over the light sources 3 and extending to the two housing sides, could be used.

Further it is to be noted that, as an alternative to the illustrated embodiments, in which the reflectors are formed by independent components or components separate from the housing 2, it would also be conceivable at least in part to use the inner wall of the luminaire housing 2 as a reflector surface. In order also to obtain the preferred concavely formed reflector surface in this case, the housing may, for example, be angled in its corner regions or have corresponding inserts, in order in the end to form a concave shape formed by a plurality of part surfaces.

Generally the luminaire 1 in accordance with the invention illustrated in FIG. 1 should have comparable lighting technical qualities as the luminaire known from WO 01/59364 A1. Thus, on the one hand, light should be directed—that is, issued in determined angular ranges. On the other hand, light should be issued over a larger area in an undirected manner or diffusely. Whilst this is attained in the case of known luminaire by the use of diffusers arranged beside one another and luminaire rasters, this kind of issue of light is effected in the case of luminaire in accordance with the invention through a particular configuration of the light exit element 5, which is now to be explained in more detail.

A particular feature of the light exit element 5 in accordance with the invention consists in that this extends over the entire light exit opening of the luminaire housing 2 and correspondingly closes this completely. Thereby it can be provided, in particular according to the representation in FIG. 1, that the light exit element 5 is formed flat and arranged such that it ends flush with the underside of the housing 2 and correspondingly with the surrounding ceiling at which the luminaire 1 is mounted. In this case a particularly simple cleaning of the luminaire 1 is made possible.

It is now however ensured, despite this particular configuration of the light exit element 5, that light is issued in the above-described manner. The light exit element 5 is namely so configured that this has in different regions different light emission characteristics.

Thus, firstly, light is emitted directionally in a first emission region A which is formed in substance below the two fluorescent lamps 3. Light issued via this exit region A thus leaves the light exit element 5 such that the light beams do not exceed a predetermined maximum exit angle with respect to the perpendicular to the surface of the light exit element 5. This maximum light exit angle typically lies in a region of about 60°, through which it is attained that the light issued in this way is dazzle-free. A person observing the luminaire 1 in accordance with the invention is thus not dazzled. Further, reflections are avoided to the greatest extent at perpendicularly standing surfaces, in particular screens and the like.

Besides this first emission region A, via which a directional issue of light is effected, there are formed to the two sides thereof second emission regions B via which light is issued non-directionally; that is, diffusely. Thus, as in the case of known luminaire the first emission region A provided for the direct issue of light is brightened in its surroundings, which from a lighting technical point of view brings about particular advantage. For a person observing the luminaire it is namely not always recognizable, on the basis of the issue of light via the first emission region A, whether the luminaire is in operation or not, which is often perceived as unpleasant. The additional, diffuse issue of light in all directions via the second emission regions B, however, avoids these difficulties. Upon observing the luminaire 1, it is thus recognizable immediately and directly whether this is switched on or not.

It can thus be understood from the above explanation that the light exit element 5 has in different regions the most different lighting technical qualities. In the first emission region A a directional issue of light is effected whilst in the second emission regions B the light exit element 5 acts as a diffuser. Since in the illustrated embodiment the light exit element 5 forms a surface extending over the entire opening of the housing 2 particular measures must thus be taken through which these different light emission characteristics are attained. For this there are different possibilities which will be explained in more detail below.

In the case of the embodiment illustrated in FIG. 1 it is for example provided that the light exit element 5 is formed by a light permeable plate 50, for example of PMMA, which is formed transparent in the first light emission region A. Light beams which leave the plate 50 in this first light emission region A are thus little or not at all influenced thereby. In order, despite everything, to attain a directional issue of light it is now provided that a supplementary light influencing element 6 is arranged in the first emission region A at the upper side of the plate 50 which effects a corresponding light guiding. This supplementary light influencing element 6 may for example be a microprism structure, a raster element or a grid element. Such elements are known from the state of the art, for example DE 103 15 268 A1 and DE 10 2004 039 676 A1, and have a plurality of prisms, grid or lamella parts arranged parallel to one another which are so configured that they deflect or reflect the light, seen in a direction, such that this is issued solely in determined angular ranges. Such prism elements, grid elements or raster elements can be realized with structural heights of only a few millimeters so that they can be used immediately in the case of the luminaire 1 in accordance with the invention.

The arrangement of this supplementary light influencing element 6 is effected in the illustrated example in that there are provided at the upper side of the light exit element 5 two webs 51 running parallel to the light sources 3 which define a receiving region into which the supplementary light influencing element 6 is simply placed. An additional fastening is not necessarily required in the case of this variant, but may of course be provided.

Through the use of the light influencing element 6, it is thus attained that light issued via the first light emission region A is directed or bundled in a particular manner. The regions of the plate 50 forming the second light emission regions B are, however, so treated that light passing through them is issued in scattered manner and correspondingly diffusely. This can be attained by a suitable treatment of the surface of the plate 50; alternatively thereto in these regions there could also be added to the material scattering bodies which favour the desired diffuse issue of light. Through this the desired second emission characteristic, different from the emission characteristic of the first emission region A, is attained.

Also in the case of luminaire 1 in accordance with the invention it is desired that the light issued via the second light emission regions B has a light intensity as uniform as possible. Correspondingly there are in turn formed by the reflectors 4 and the light exit element 5 arranged therebefore two so-called light chambers 10 located to the sides of light sources 3 into which a part of the light issued by the light sources 3 is incident and so reflected by the reflectors 4 onto the light exit element 5 that an issue of light as homogeneous as possible is attained. The concept of such so-called light chambers is already known from WO 01/59364 A1 mentioned above.

Seen overall there is thus formed a luminaire which is comparable to the known luminaire mentioned in the introduction with regard to its lighting technical qualities. An advantage over the known luminaire consists, however, in the higher maintenance factor since a cleaning of the luminaire illustrated in FIG. 1 is considerably more simply to be carried out due to the closed and flush underside.

Figure 2:
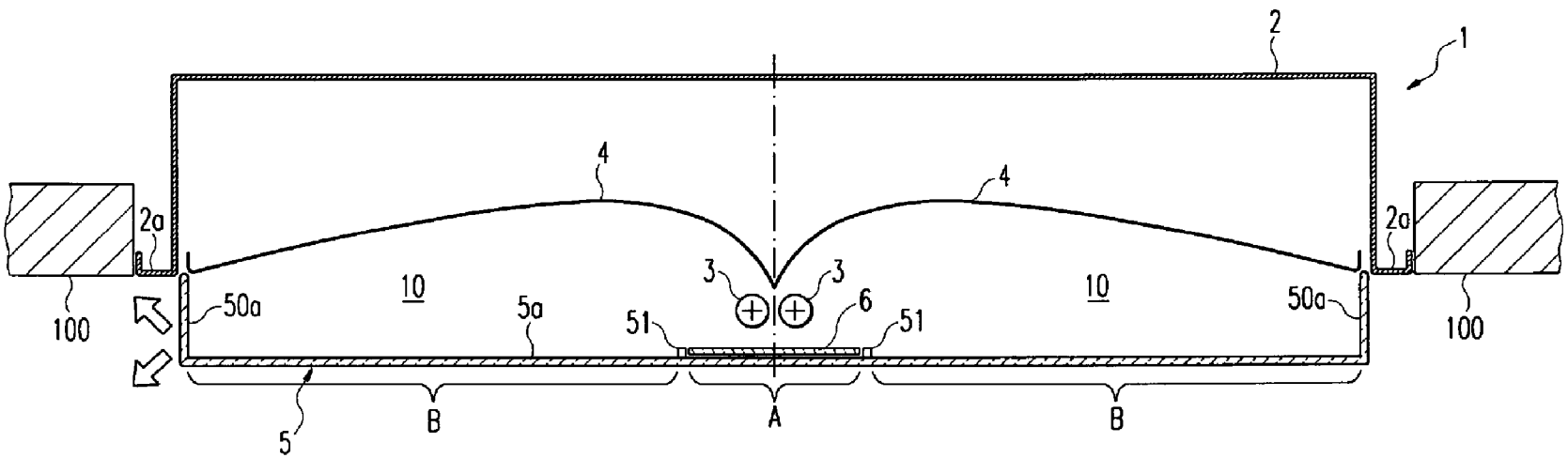
FIG. 2 a variant of the luminaire illustrated in FIG. 1.

FIG. 2 now shows a variant or development of the luminaire in accordance with FIG. 1. The development consists in that the light exit element 5 is now adjustable in light emission direction with respect to the luminaire housing 2. In particular the possibility now exists of so arranging the light exit element 5 that this slightly projects with respect to the luminaire housing 2, as is shown in FIG. 2.

Firstly, with this configuration, light is issued via the first and second emission regions A and B in the manner described above. Due to the projecting arrangement of the light exit element 5 there is now effected however also an additional issue of light via side walls 50*a* of the light exit element 5, which is indicated in FIG. 2 by arrows. Also the side walls 50*a* of the light exit element 5 are preferably configured such that they scatter light or issue light diffusely, for which reason light emerging via these side walls 50*a* is issued in the most varied directions. In particular, however, the ceiling regions 100 surrounding the luminaire 1 are also brightened. Through this, particularly advantageous lighting technical qualities are provided since in the end, starting from the first light emission region A, via which the directional issue of light is effected, and the second light emission regions B, via which diffuse light is emitted, a continuous transition is attained on the surrounding ceiling regions 100. The brightness then decreases further outwardly.

It is to be noted that in the embodiment in accordance with FIG. 2 the light exit element 5 is not adjusted alone with respect to the luminaire housing 2. Instead the light sources 3, the reflectors 4 and the light exit element 5 form a structural unit which is adjusted as a whole with respect to the housing 2. The advantage in the case of this variant consists in that the arrangement of the light sources 3, the reflectors 4 and the light exit element 5 with respect to one another is not changed, so that as before the homogeneous issue of light via the light chambers 10 and the second emission regions B, and the directional emission via the first emission region A, is retained. Of course would be also conceivable, however, to adjust the light exit element 5 alone. The most varied possibilities for the realization of the adjustability would be conceivable, wherein for example a corresponding latching with the side walls of the housing 2 or a corresponding screwing on through the use of elongate holes or a plurality of screw bores would be conceivable. Also the luminaire illustrated in FIG. 2 has a high maintenance factor since the light exit element 5, as before, closes the luminaire housing 2 to the forward side.

Below, further possibilities for the realization of the light exit element 5 in accordance with the invention will be explained. In the case of all the variants described below it is provided that centrally a first region is formed, via which an issue of light is directionally effected, whilst in contrast to the side hereof a diffuse issue of light is attained. The different variants thereby relate in particular to different measures for the formation of the middle region for the directional issue of light, wherein these measures relate primarily to the fastening of a supplementary light influencing element 6 to the plate 50 of the light exit element. In principle, there can however selectively also be used a prism structure, a grid structure or a (micro-)raster as light influencing element 6.

Figure 3A:
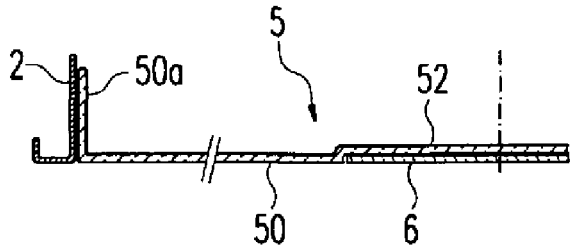
FIGS. 3*a* and 3*b* different positions of a light exit element in accordance with the invention.
Figure 3B:
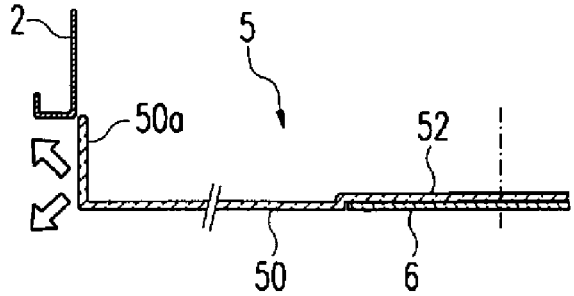

Whilst in the case of embodiment in accordance with FIGS. 1 and 2 it was provided that a prism element, grid element or raster element was arranged more or less loose at the upper side of the light permeable plate 50 of the light exit element 5, in the case of the embodiment of FIGS. 3*a* und 3*b* it is provided that this supplementary light influencing element 6 is now arranged at the underside of the plate 50. For this purpose the plate 50 has a depression or recess 52, into which the supplementary light influencing element 6 is placed. A fastening of the light influencing element 6 can then be effected for example by means of adhering or by means of a two component injection technique. It is, however, provided in turn that the plate 50 of the light exit element 5 is configured transparent in the region of the supplementary light influencing element 6, whilst in contrast the surrounding regions and the side walls 50 are light scattering and correspondingly act as diffuser. In the case that the light exit element 5 is arranged projecting with respect to the housing opening, in turn thus a lateral issue of light is attained, as is illustrated schematically in FIG. 3*b*.

Figure 4:
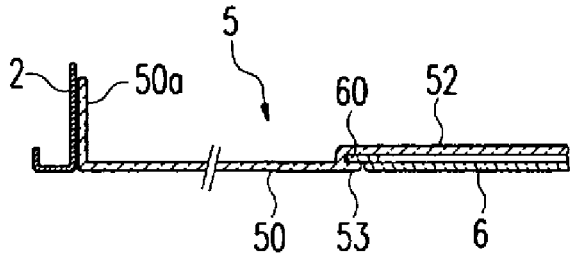
FIGS. 4 to 9 different variants for realization of a light exit element having different light emission characteristics.

A further variant for the formation of the light exit element 5 in accordance with the invention is illustrated in FIG. 4. In turn the supplementary light influencing element 6 is arranged at the underside of the plate 50, wherein the plate 50 now has a recess 52, which forms lateral grooves or furrows 53. Into these grooves 53. Into these grooves 53 there engage laterally projecting webs 60 of the light influencing element 6, so that this is held in the recess 52 without additional adhering. For assembly hereby the light influencing element 6 can be threaded into the recess 52 end-wise.

Figure 5:
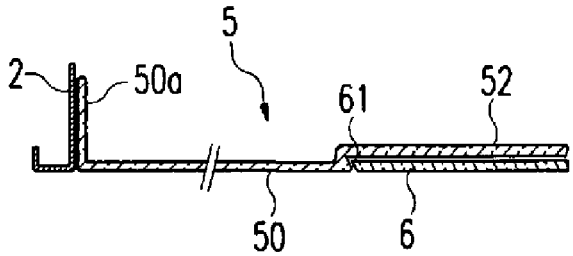

A very similar solution is illustrated in FIG. 5 in the case of which the light influencing element 6 has at its sides inclined section edges 61. Through these a clamping of the light influencing element 6 in the recess 52 of the light exit element 5 is made possible.

Figure 6:
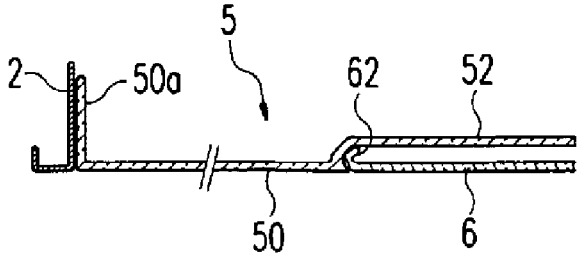

Also in the case of embodiment illustrated in FIG. 6 the light influencing element 6 is clamped with the light exit element 5. For this purpose the recess 52 is, however, now configured a little more deeply, whereby lateral arms 62 of the light influencing element 6 have a certain flexibility and are clamped with the light exit element 5, so that the light influencing element 6 can simply be snapped into the light exit element 5.

Figure 7:
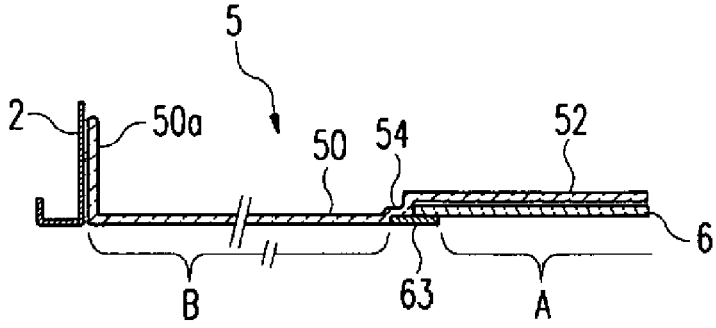
Figure 8:
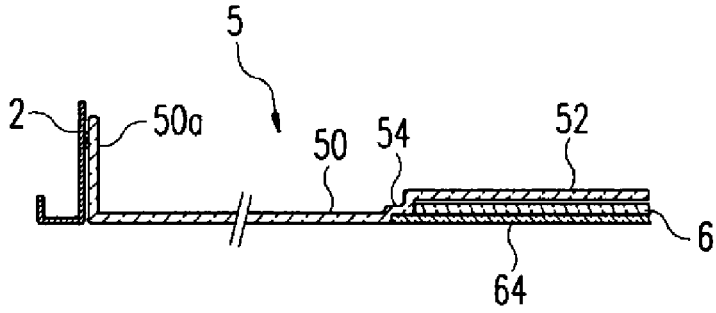

Further variants are illustrated in FIGS. 7 and 8. In both cases the recess 52 for receiving the light influencing element 6 is configured in its edge region in a stepped manner, whereby in the case of the example in accordance with FIG. 7 a light-tight strip 63 is partly adhered with the plate 50 and the light influencing element 6. Through this there is additionally also attained an optical separation of the first emission region A for the directional issue of light and the second emission region B for the diffuse issue of light. In the case of the variant in accordance with FIG. 8 a transparent plate or foil is adhered over the complete surface onto the underside of the light influencing element 6, so that this is connected with the plate 50.

All described variants distinguish themselves in that an in substance flat surface is formed for the light exit element 5, which makes possible a simple cleaning of the luminaire. Further, in all cases, there can be attained an adjustability of the light exit element 5 with respect to the luminaire housing 2, since side walls 50*a* projecting laterally upwardly are provided.

Figure 9:
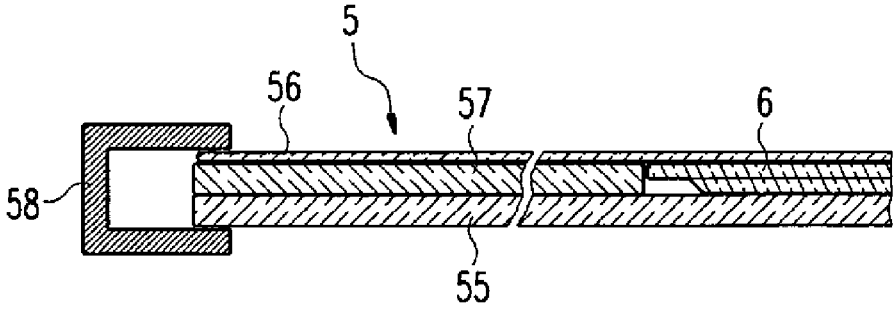

In the case of variant in accordance with FIG. 9 an adjustability of the light influencing element 5, is, however, not possible. In the case of this embodiment the light exit element is formed by a sandwich structure which has at its underside a transparent plate, for example of PMMA, and at its upper side a diffusely scattering foil. Between the two elements 55 and 56 there are arranged on the one hand a diffusor plate 57 and on the other hand a light influencing element 6. This sandwich structure is held together by brackets 58 at its ends, so that a particularly simple construction is provided for the light exit element 5.

Figure 10:
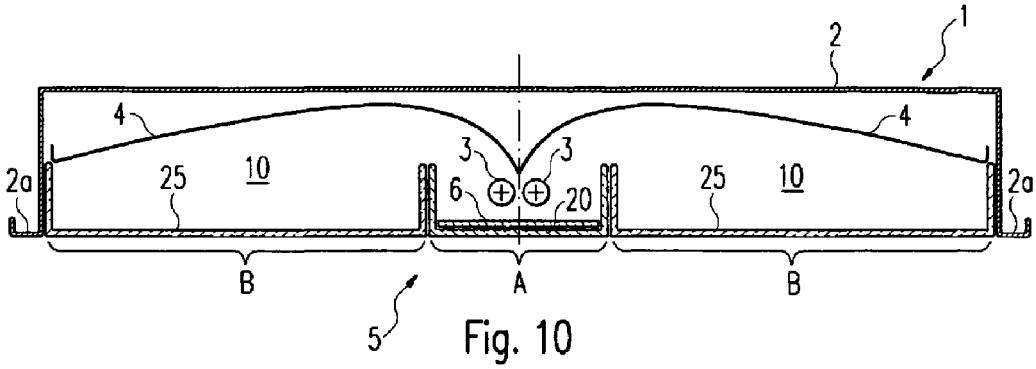
FIG. 10 a further embodiment of a luminaire in accordance with the invention, in the case of which the light exit element is formed by a plurality of part elements.
Figure 11:
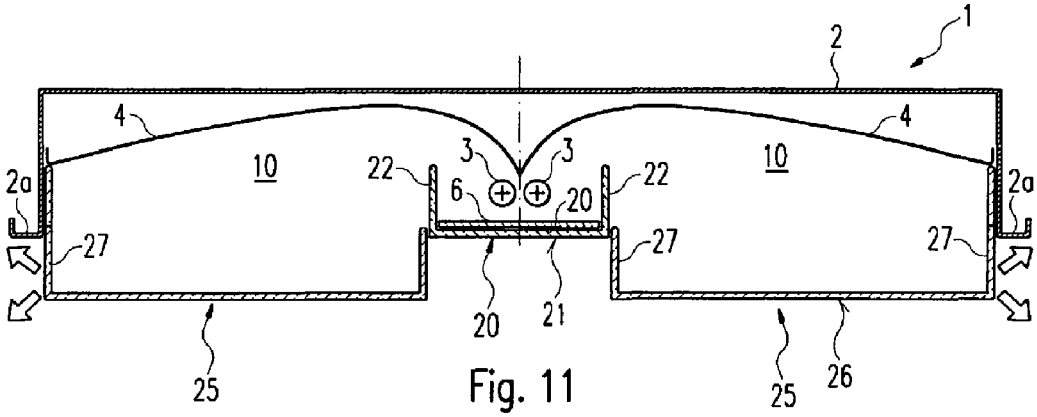
FIGS. 11 and 12 the luminaire in accordance with FIG. 10, wherein the part elements of the light exit element assume different positions.
Figure 12:
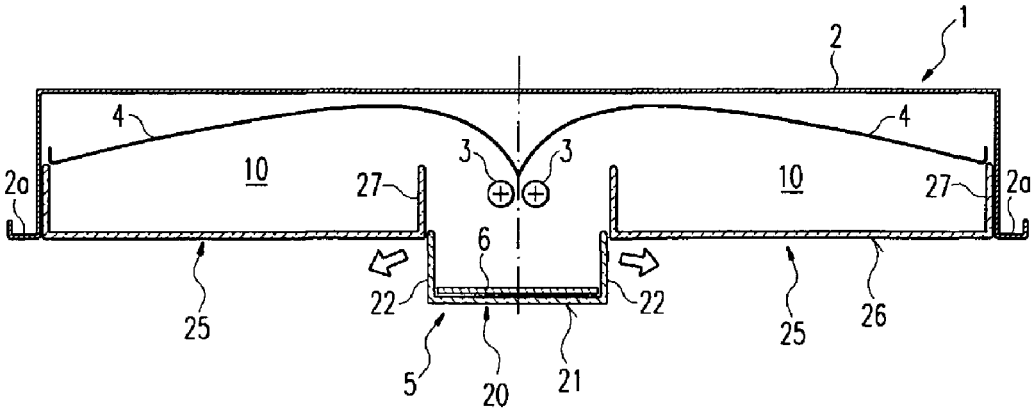

In the case of all embodiments described above the light exit element 5 was formed by an element which as a single component completely closed the luminaire housing towards the front and—so far as this is provided—could be adjusted with respect to the housing. FIGS. 10 to 12 now show an alternative embodiment of a luminaire in accordance with the invention in the case of which there are further possibilities for the adjustability of the light exit element, through which a brightening of the surrounding ceiling region is made possible.

Firstly the luminaire 1 illustrated in FIG. 10 is structured in a comparable manner to the luminaire in accordance with FIG. 1; thus it consists of a box-like luminaire housing 2, one or a plurality of rod-shaped light sources 3, wing-like reflectors 4, and a light exit element 5 which closes off the front of the housing 2. A difference now, however, consists in that the light exit element 5 is formed by a plurality of part elements, which each bring about an issue of light in a determined manner and—as will be explained in more detail below—are adjustable in light emission direction. Thereby a first part element is provided with the reference sign 20 and forms the first emission region A provided for directional emission. Correspondingly the part element 20 is located below the light sources 3. Further second part elements 25 are arranged to the two sides of the first part element 20 and respectively form the second light emission regions B via which a diffuse issue of light is effected. All three part elements 20 and 25, arranged beside one another, form the light exit element 5 as a whole, which closes off the luminaire housing 2 to the front.

The first part element 20 has a lower light exit surface 21 and side walls 22. The light exit surface 21 is thereby so configured that light passing therethrough is issued directionally. Correspondingly in turn the measures for attaining a directional issue of light as described above can be used. In particular—as illustrated—there could be placed between the side walls 22 a micro-raster, a grid element or prism element as a light influencing element 6. In this case the light exit surface 21 is again preferably configured to be transparent. Also the variants described with reference to FIGS. 3 to 8 also would be conceivable for the formation of a light exit element for the directional issue of light. The side walls 22 of the first part element 20 are, in contrast, preferably configured to be diffusely emitting since light issued via these side walls should as far as possible be scattered in the most varied directions.

The second part elements 25, just like the first part element 20, are configured trough-like; thus having a lower light exit surface 26 and side walls 27. Since the second part elements 25 define the second emission surface B it is now, however, provided that all walls of the second part elements 25 are constituted in light scattering manner so that these elements act completely as diffusers.

A particular feature of this luminaire 1 consists now in that at least one of the two part elements 20, 25, preferably both, are adjustable in light emission direction. Thus firstly there arises the possibility of arranging all elements 20, 25 such that they end flush with the luminaire housing 2 and with that with the surrounding ceiling region. As is shown in FIG. 11 the two lateral second part elements 25 could however also be arranged in projecting manner. As also in the case of the embodiment in accordance with FIG. 2 it is achieved through this that via the side walls 27 of the second part elements 25 light is emitted diffusely so that surrounding ceiling regions are brightened. As before there is still however effected the preferred directional issue of light to the underside via the first part element 20. Further the region surrounding the first part element 20 is brightened via the undersides 26 of the second part elements 25.

Alternatively to the configuration in FIG. 11 it could further also be provided that the first part element 20 is arranged to project whilst in contrast the second part elements 25 end flush with the luminaire housing 2. Also in the case of this variant illustrated in FIG. 12 a lateral diffuse issue of light is effected via the side walls 22 of the first part element 20. The effect for the brightening of surrounding ceiling regions is here, however, considerably slighter, since these side walls 22 are arranged more remotely from the edge regions of the luminaire housing. Despite everything, positive lighting technical qualities are obtained also in this variant.

In turn the possibility for the adjustment of the part elements in light emission direction can be opened up in that these are latchable in a suitable manner with the side walls of the luminaire housing 2. Also a corresponding screwing on in a desired position can be provided.

In summary, through the present invention there is provided a luminaire which on the one hand is easy to clean and correspondingly manifests a high maintenance factor. On the other hand at least comparable positive lighting technical qualities are obtained as in the case of known luminaires. If, further, a configuration is chosen in which the light exit element or parts thereof project with respect to the luminaire, additionally the ceiling region surrounding the luminaire can also be brightened. The lighting technical qualities of the luminaire in accordance with the invention are even further improved through this.

The invention claimed is:

1. Luminaire comprising:

a box-like luminaire housing for receiving at least one elongate light source and at least one reflector surface arranged, as seen from a region to be illuminated, neighbouring the light source, wherein the luminaire housing forms a light exit opening which is closed by a light exit element wherein, the light exit element has in a first emission region, located in front of the light source, a first light emission and a light influencing element, said light influencing element causing a directed emission of light, and has in a second emission region, separate from the first emission region, a second light emission different with respect to the first light emission, wherein light leaving the luminaire via the first emission region is emitted solely in a determined angular range, the light exit element further including a light exit plate which in the first emission region is transparent, wherein the light influencing element is arranged at one of an upper side of the first emission region and an underside of the first emission region.

2. Luminaire according to claim 1, wherein, light leaving the luminaire via the second emission region is diffusely scattered.

3. Luminaire according to claim 1, wherein, the light influencing element has a prism structure, grid structure or raster structure.

4. Luminaire according to claim 1,
wherein,
the light influencing element is connected with the light exit plate in one piece.

5. Luminaire according to claim 4,
wherein,
the light influencing element is latched with the light exit plate.

6. Luminaire according to claim 1,
wherein,
the light exit element lies in a plane of the light exit opening of the luminaire housing.

7. Luminaire according to claim 1,
wherein,
the light exit element is adjustable perpendicular to a plane of the light exit opening.

8. Luminaire according to claim 7,
wherein,
the light exit element is adjustable with respect to the light source and the reflector surface.

9. Luminaire according to claim 7,
wherein,
the light exit element has in an edge region side walls directed towards the housing.

10. Luminaire according to claim 9,
wherein,
the side walls of the light exit element act in a light scattering manner.

11. Luminaire according to claim 1,
wherein,
an underside of the light exit element is substantially flat.

12. Luminaire according to claim 1,
wherein,
the light exit element is of a plurality of part elements,
wherein a first part element is arranging substantially in front of the light source and a second part element is arranged in substance in front of the reflector surface, and
wherein the first and the second part element is adjustable in light emission direction.

13. Luminaire according to claim 12,
wherein,
the first part element forms the first emission region and the second part element forms the second emission region.

14. Luminaire according to claim 12,
wherein,
the two part elements have in an edge region side walls, directed towards the housing, which act in a light scattering manner.

15. Luminaire according to claim 1,
wherein,
the reflector surface is formed wing-like.

16. Luminaire according to claim 1,
wherein,
the reflector surface is formed at least in part by an inner wall of the luminaire housing.

17. Luminaire according to claim 1,
wherein,
the reflector surface is formed by an independent reflector.

18. Luminaire according to claim 1,
wherein,
this is constituted symmetrically and a reflector surface extends to the two sides of the light source.

19. Luminaire comprising:
a box-like luminaire housing for receiving at least one elongate light source and at least one reflector surface arranged, as seen from the region to be illuminated, neighbouring the light source,
wherein the luminaire housing forms a light exit opening which is closed by a light exit element wherein,
the light exit element is adjustable perpendicular to a plane of the light exit opening.

20. Luminaire comprising:
a box-like luminaire housing for receiving at least one elongate light source and at least one reflector surface arranged, as seen from the region to be illuminated, neighbouring the light source,
wherein the luminaire housing forms a light exit opening which is closed by a light exit element wherein,
the light exit element is of a plurality of part elements,
wherein a first part element is arranging substantially in front of the light source and a second part element is arranged in substance in front of the reflector surface, and
wherein the first and/or the second part element is adjustable perpendicular to a plane of the light exit opening.

21. Luminaire according to claim 20,
wherein,
the first element has a first light emission characteristic and the second part element has a second light emission characteristic which is different with respect to the first light emission characteristic.

* * * * *